US010410801B2

(12) United States Patent
Zhang

(10) Patent No.: US 10,410,801 B2
(45) Date of Patent: Sep. 10, 2019

(54) SCISSOR STRUCTURE FOR KEY OF KEYBOARD

(71) Applicant: Jiangsu Transimage Technology Co., Ltd., Gaoyou, Jiangsu (CN)

(72) Inventor: Qing Zhang, Jiangsu (CN)

(73) Assignee: Jiangsu Transimage Technology Co., Ltd., Gaoyou, Jiangsu (CN)

( * ) Notice: Subject to any disclaimer, the term of this patent is extended or adjusted under 35 U.S.C. 154(b) by 60 days.

(21) Appl. No.: 15/803,377

(22) Filed: Nov. 3, 2017

(65) Prior Publication Data

US 2018/0269011 A1 Sep. 20, 2018

(30) Foreign Application Priority Data

Mar. 15, 2017 (CN) ..... 2017 1 01543047

(51) Int. Cl.
*H01H 3/12* (2006.01)
*H01H 13/705* (2006.01)
*H01H 13/7073* (2006.01)

(52) U.S. Cl.
CPC ..... *H01H 3/125* (2013.01); *H01H 13/705* (2013.01); *H01H 13/7073* (2013.01); *H01H 2229/046* (2013.01)

(58) Field of Classification Search
CPC ..... H01H 3/125
USPC ..... 400/473
See application file for complete search history.

(56) References Cited

U.S. PATENT DOCUMENTS 5,488,210 A * 1/1996 Shigetaka ..... H01H 3/125 200/344
6,268,578 B1 * 7/2001 Nakai ..... H01H 3/125 200/344
6,570,113 B2 * 5/2003 Yu ..... H01H 3/125 200/344
6,906,272 B1 * 6/2005 Tsai ..... H01H 3/125 200/344
7,417,200 B2 * 8/2008 Hsu ..... H01H 3/125 200/344
9,214,293 B2 * 12/2015 Chen ..... H01H 3/125
2017/0191612 A1 * 7/2017 Yen ..... G06F 3/02

* cited by examiner

*Primary Examiner* — Anthony H Nguyen
(74) *Attorney, Agent, or Firm* — Rankin, Hill & Clark LLP

(57) ABSTRACT

A scissor structure for a key of a keyboard includes an inner scissor and an outer scissor, wherein the inner scissor is fixedly connected with the outer scissor through an elastic connecting pin; when the key is pressed, the inner scissor and the outer scissor are pressed therewith, and drive the elastic deformation of the connecting pin; when the key is loosened, the inner scissor and the outer scissor are restored to an initial state under the elastic restoring force of the connecting pin, so as to transmit the key.

7 Claims, 1 Drawing Sheet

SCISSOR STRUCTURE FOR KEY OF KEYBOARD

TECHNICAL FIELD

The present invention relates to a scissor structure, and more particularly, to a scissor structure for a key of a keyboard.

BACKGROUND

A transmission component in a key structure of a traditional keyboard is a scissor transmission component, which comprises an inner scissor and an outer scissor. A connecting shaft is extendedly arranged along symmetrical sides on the inner scissor. A shaft hole is arranged at a corresponding position of the outer scissor. The inner scissor is coupled and matched with the outer scissor through the shaft hole. However, such transmission component has high production cost, and is difficult to control quality; moreover, it is hard to assemble, which requires a large amount of artificial assembly, and the production efficiency is low. Moreover, gaps may also be caused to shaft hole matching, so that the transmission structure is loosened.

SUMMARY

Object of the invention: regarding the problems of high cost, poor quality, difficult assembly and easy loosing of the traditional scissor structure, the present invention provides a scissor structure for a key of a keyboard.

Technical solution: the scissor structure for a key of a keyboard according to the present invention comprises an inner scissor and an outer scissor, wherein the inner scissor is fixedly connected with the outer scissor through an elastic connecting pin; when the key is pressed, the inner scissor and the outer scissor are pressed therewith, and drive the elastic deformation of the connecting pin; when the key is loosened, the inner scissor and the outer scissor are restored to an initial state under the elastic restoring force of the connecting pin, so as to transmit the key.

To be specific, both the inner scissor and the outer scissor are rectangle frames, and the inner scissor is located inside the frame of the outer scissor, wherein the inner scissor comprises a pair of inner scissor base arms and a pair of inner scissor side arms, the outer scissor comprises a pair of outer scissor base arms and a pair of outer scissor side arms, the inner scissor side arms and the outer scissor side arms which are adjacent are fixedly connected through the connecting pin. Preferably, the inner scissor side arms and the outer scissor side arms which are adjacent are fixedly connected with two axial ends of the connecting pin.

Further, the inner scissor and the outer scissor are integrally connected with the connecting pin. At the moment, the whole scissor structure may be manufactured through two-shot molding.

Wherein, the connecting pin is made of an elastic material. The elastic material may be plastics or rubber.

Beneficial effects: compared with the prior art, the present invention has the obvious advantages that: (1) according to the scissor structure for a key of a keyboard of the present invention, the inner scissor is connected with the outer scissor through the elastic connecting pin, and the transmission of the inner scissor and the outer scissor is achieved through deformation and the elastic restoring force of an elastic material, so that a transmission structure is tight, and the quality of the key may be obviously increased when the scissor structure is used in the key of the keyboard; and (2) the scissor structure may be manufactured through two-shot molding, and double injection of the inner and outer scissors may also be achieved; then the elastic connecting pin is injected through another material after the inner and outer scissors are injected, so that the labor cost can be greatly reduced, the production efficiency can be improved, and meanwhile, the product quality may also be effectively controlled.

DETAILED DESCRIPTIONS

The technical solution of the present invention will be further described hereinafter with reference to the drawings.

Figure 1:
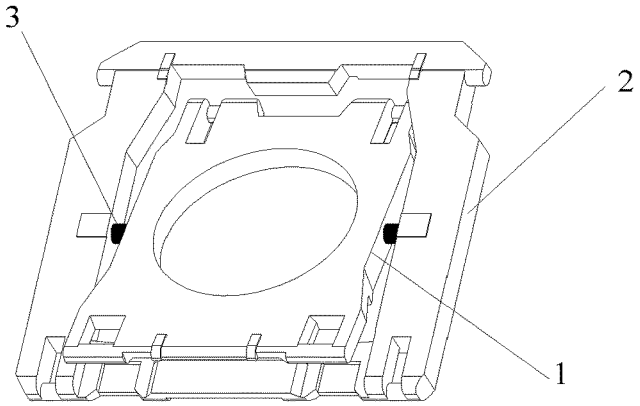
FIG. 1 is a schematic diagram of a scissor structure for a key of a keyboard according to the present invention.

As illustrated in FIG. 1, a scissor structure for a key of a keyboard according to the present invention comprises an inner scissor 1 and an outer scissor 2, and further comprises a connecting pin 3 which is arranged between the inner scissor 1 and the outer scissor 2, and used for fixedly connecting the inner scissor to the outer scissor. The connecting pin 3 has elasticity, and can be made of an elastic material such as plastics or rubber.

The inner scissor 1 and the outer scissor 1 may be rectangle frames, and the inner scissor 1 is located inside the frame of the outer scissor 2.

Figure 2:
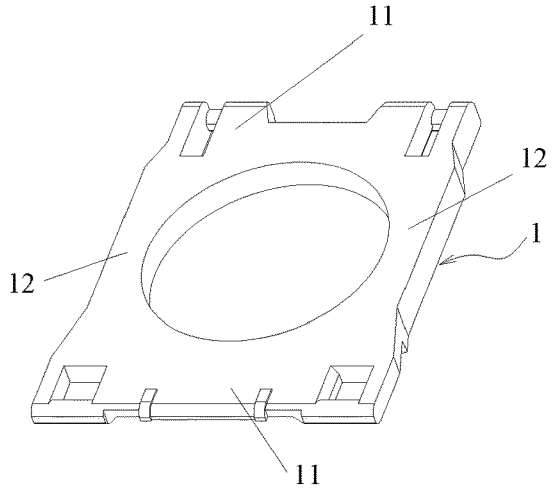
FIG. 2 is a structure diagram of an outer scissor in the scissor structure according to the present invention.
Figure 3:
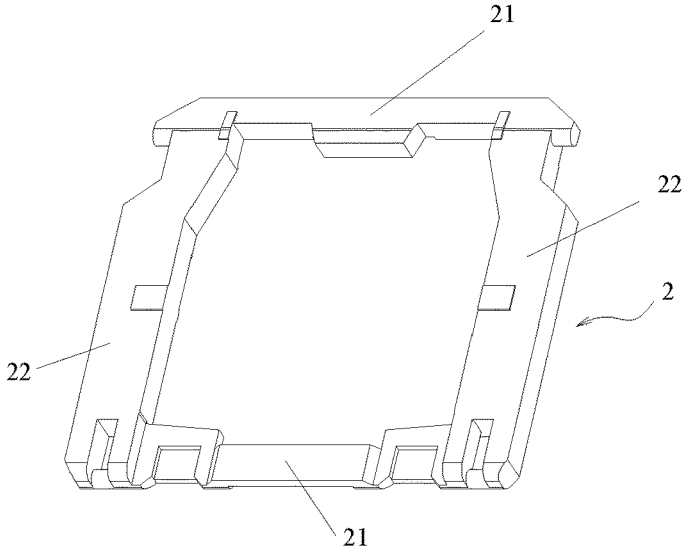
FIG. 3 is a structure diagram of an inner scissor in the scissor structure according to the present invention.

As illustrated in FIGS. 2 to 3, the inner scissor 1 comprises a pair of inner scissor base arms 11 and a pair of inner scissor side arms 12, the outer scissor 2 comprises a pair of outer scissor base arms 21 and a pair of outer scissor side arms 22, the connecting pin 3 is between the inner scissor side arm 12 and the outer scissor side arm 22 which are adjacent to fixedly connect the inner scissor 1 with the outer scissor 2, for example, the two axial ends of the connecting pin 3 may be respectively fixed with the inner scissor side arms 12 and the outer scissor side arms 22.

When the scissor structure of the present invention is used in the key of the keyboard, under an initial state, the inner scissor 1 and the outer scissor 2 are intercrossed by a certain angle; at the moment, the connecting pin 23 is also under an unstressed state; when the key is pressed, the inner scissor 1 and the outer scissor 2 are pressed therewith, and both rotate in a direction relatively opposite to the connecting pin 3 under the pressure effect, so that the angle between the two is decreased gradually, and elastic deformation occurs to the connecting pin 3 under the pulling of the inner scissor 1 and the outer scissor 2; and after the key is loosed, the pressure is relieved, the connecting pin 3 returns to the initial state depending on the elastic restoring force thereof, and drives the inner scissor 1 and the outer scissor 2 to return to the initial state, and the key is transmitted during the whole process.

Compared with the traditional scissor structure adopting shaft hole coupling and matching, the scissor structure of the present invention is not provided with a shaft hole, and implements transmission through the deformation and the elastic restoring force of the connecting pin 3, so that a transmission structure is tight, and the quality of the key may be obviously increased when the scissor structure is used in the key of the keyboard; moreover, it only needs to arrange the connecting pin 3 having elasticity between the inner scissor 1 and the outer scissor 2, so that the assembly difficulty is greatly reduced.

The inner scissor 1 and the outer scissor 2 may be integrally connected with the connecting pin 3. At the moment, the scissor structure may be manufactured through two-shot molding, wherein the inner scissor 1 and the outer scissor 2 are molded by the same material, and the connecting pin 3 is molded by another material; moreover, double injection of the inner and outer scissors may also be achieved; then the connecting pin having elasticity is injected after the inner and outer scissors are injected; compared with the traditional art, the process automation is high, which can greatly reduce the assembly cost and the production cost and improve the production efficiency. Meanwhile, the product quality may also be effectively controlled.

The invention claimed is:

1. A scissor structure for a key of a keyboard, comprising: an inner scissor (1), and an outer scissor (2), and an elastic connecting pin (3) made of an elastic material, wherein the inner scissor (1) is fixedly connected with the outer scissor (2) through the elastic connecting pin (3);

wherein when the key is pressed, the inner scissor (1) and the outer scissor (2) are configured to be pressed together with the key toward a pressed state, and pressing of the inner scissor (1) and the outer scissor (2) causes elastic deformation of the connecting pin (3); and when the key is loosened, the inner scissor (1) and the outer scissor (2) are restored to an initial state under an elastic restoring force of the connecting pin (3), wherein transmission of the scissor structure is through deformation and the elastic restoring force of the connecting pin.

2. The scissor structure for a key of a keyboard according to claim 1, wherein both the inner scissor (1) and the outer scissor (2) are rectangle frames, and the inner scissor (1) is located inside the frame of the outer scissor (2), the inner scissor (1) comprises a pair of inner scissor base arms (11) and a pair of inner scissor side arms (12), the outer scissor (2) comprises a pair of outer scissor base arms (21) and a pair of outer scissor side arms (22), the inner scissor side arms (12) and the outer scissor side arms (22) which are adjacent are fixedly connected through the connecting pin (3).

3. The scissor structure for a key of a keyboard according to claim 2, wherein the neighboring inner scissor side arms (12) and the outer scissor side arms (22) which are adjacent are fixedly connected with two axial ends of the connecting pin (3).

4. The scissor structure for a key of a keyboard according to claim 1, wherein the inner scissor (1) and the outer scissor (2) are integrally connected with the connecting pin (3) to define a unitary, one-piece scissor structure.

5. The scissor structure for a key of a keyboard according to claim 4, wherein the scissor structure is manufactured through two-shot molding.

6. The scissor structure for a key of a keyboard according to claim 1, wherein the elastic material is plastics or rubber.

7. The scissor structure for a key of a keyboard according to claim 1, wherein the scissor structure is devoid of a shaft hole having an open notched portion for receiving the connecting pin (3).

* * * * *